US007490978B2

(12) United States Patent
Crisci

(10) Patent No.: US 7,490,978 B2
(45) Date of Patent: Feb. 17, 2009

(54) ANALOG WRISTWATCH HAVING A MULTI-BEZEL TIMING MECHANISM

(76) Inventor: Jacqueline Crisci, 1856 Walthall Dr., Atlanta, GA (US) 30318

( * ) Notice: Subject to any disclaimer, the term of this patent is extended or adjusted under 35 U.S.C. 154(b) by 0 days.

(21) Appl. No.: 11/858,702

(22) Filed: Sep. 20, 2007

(65) Prior Publication Data

US 2008/0074953 A1 Mar. 27, 2008

Related U.S. Application Data

(60) Provisional application No. 60/826,466, filed on Sep. 21, 2006.

(51) Int. Cl.
*G04B 37/00* (2006.01)
*G04B 39/00* (2006.01)

(52) U.S. Cl. ..... 368/294; 368/295

(58) Field of Classification Search ..... 368/294, 368/295

See application file for complete search history.

(56) References Cited

U.S. PATENT DOCUMENTS

| | | | | |
|---|---|---|---|---|
| 3,665,701 | A * | 5/1972 | Burdet | 368/295 |
| 5,255,248 | A * | 10/1993 | Goodmon | 368/228 |
| 5,319,617 | A * | 6/1994 | Sonoda | 368/294 |
| 6,599,009 | B2 * | 7/2003 | Terasawa et al. | 368/295 |
| 6,821,014 | B2 * | 11/2004 | Hiranuma et al. | 368/295 |
| 7,137,732 | B2 * | 11/2006 | Takeda | 368/295 |
| 2008/0068935 | A1 * | 3/2008 | Hiranuma et al. | 368/295 |

* cited by examiner

*Primary Examiner*—Edwin A. Leon
*Assistant Examiner*—Thanh S Phan
(74) *Attorney, Agent, or Firm*—Gardner Groff Greenwald & Villanueva, P.C.

(57) ABSTRACT

The present invention relates to an analog wristwatch including a watch body and at least two bezels. The watch body further includes a face, along with an hour hand and a minute hand for telling time. The at least two bezels surround the circumference of the face and are rotatably mounted to the watch body. The bezels are used to measure elapsed time.

16 Claims, 4 Drawing Sheets

ANALOG WRISTWATCH HAVING A MULTI-BEZEL TIMING MECHANISM

CROSS-REFERENCE TO RELATED APPLICATIONS

This application claims priority to provisional patent application Ser. No. 60/826,466, entitled ANALOG WRISTWATCH HAVING A MULTI-BEZEL TIMING MECHANISM, filed on Sep. 21, 2006, which is incorporated herein by reference in its entirety.

TECHNICAL FIELD OF THE INVENTION

The present invention relates generally to analog wristwatches and more particularly, to analog wristwatches having multiple bezels for measuring increments of time.

BACKGROUND OF THE INVENTION

Typical prior art analog wristwatches have a single graduated rotating bezel surrounding the face of the watch, which is used to keep track of elapsed time. Such a bezel is often referred to as an elapsed time rotating bezel. Generally, the bezel is labeled in increments of five (5), from zero (0) to fifty-five (55). When a wearer wishes to keep track of elapsed time from one point-in-time to another, the wearer can align the zero of the bezel with the watch's second or minute hand. After a period of time has passed, the wearer can read the elapsed time off the bezel, which saves the wearer from having to perform the necessary subtraction that would occur if the wearer had used the watch's face dial.

Many types of analog wristwatches are produced with such a prior art bezel for measuring elapsed time. However, elapsed time rotating bezels are most commonly found on dive watches because divers are required to estimate their remaining air supply when underwater. On such watches, the rotating bezel is unidirectional, moving only in a counterclockwise direction. Because the bezel only moves in a counterclockwise direction, a diver who unwittingly knocks the bezel off its original position will safely underestimate their remaining air supply. Many watches featuring elapsed time rotating bezels, including dive watches, are also ratcheted to keep the bezel locked in place during use.

One significant problem with wristwatches having prior art elapsed time rotating bezels is that a user can only reliably measure time in increments that are less than one hour. It has been found that many applications require a wearer to monitor elapsed time that is greater than one, or even several hours. For instance, pregnant women must monitor the elapsed time between sequential contractions and breastfeeding mothers must monitor the elapsed time in-between feedings, naps, medicine administration, etc. Furthermore, monitoring slow cooking foods, air supply estimation during advanced diving activities, and athletic training are just a few of the numerous applications that can require a wearer to monitor time increments exceeding one hour.

Thus it can be seen that needs exist for improvements to analog wristwatches that allow a wearer to monitor time increments exceeding one hour. It is to the provision of these needs and others that the present invention is primarily directed.

SUMMARY OF THE INVENTION

In example forms, the present invention relates to an analog wristwatch including a watch body, at least two bezels, and optionally a band. The watch body further includes a face along with an hour hand and a minute hand for telling time. The at least two bezels surround the circumference of the face and are rotatably mounted to the watch body. The bezels are used to measure elapsed time. The optional band can be used to connect the watch body to a user. One advantage of the present invention over known analog watches is that a wearer can accurately measure elapsed time that exceeds one hour.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1C:
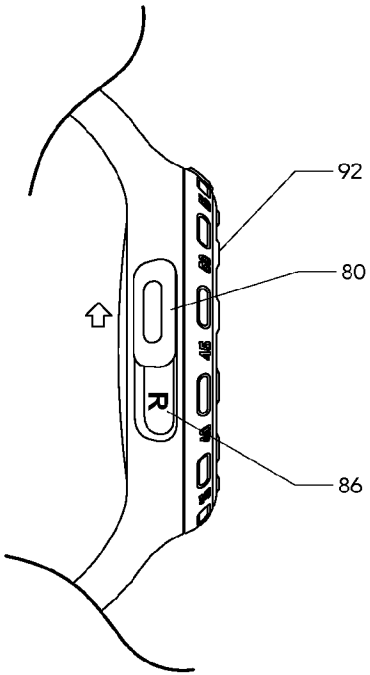
FIG. 1*c* is a side view of the analog wristwatch according to FIG. 1*a*, shown with the switch revealing the right indicator.
Figure 1B:
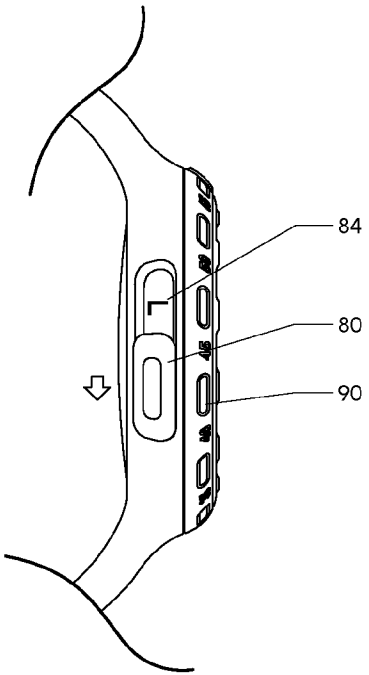
FIG. 1*b* is a side view of the analog wristwatch according to FIG. 1*a*, shown with the switch revealing the left indicator.
Figure 1A:
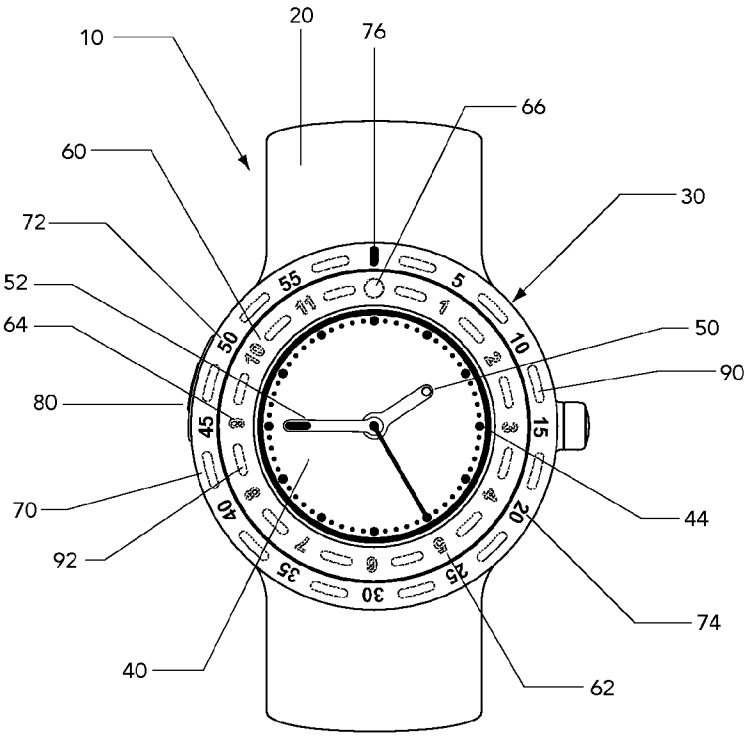
FIG. 1*a* is a plan view of an analog wristwatch according to an example embodiment of the present invention
Figure 2:
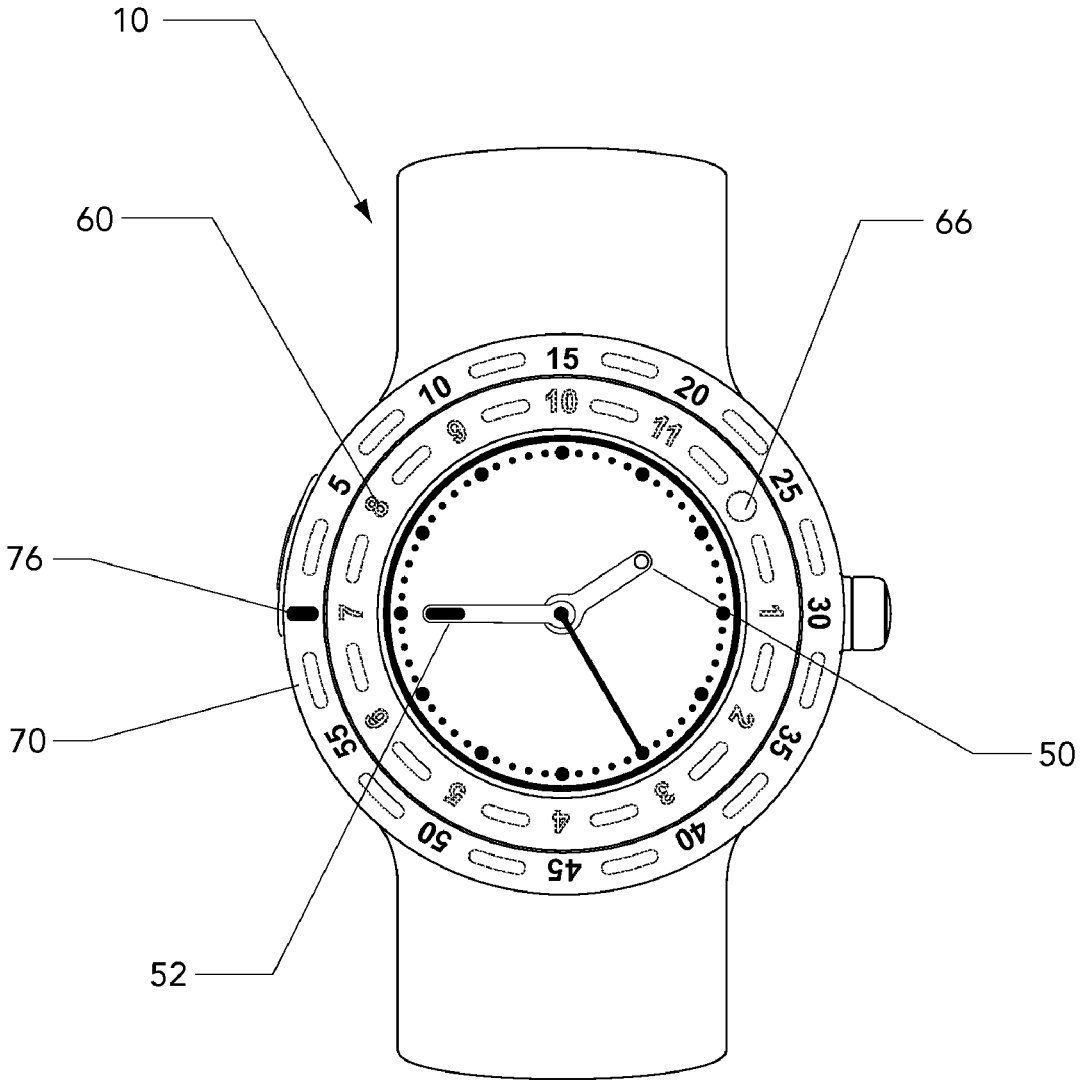
FIG. 2 is a plan view of the wristwatch of FIG. 1 shown with the bezels aligned with the hour and minute hands of the wristwatch.
Figure 3:
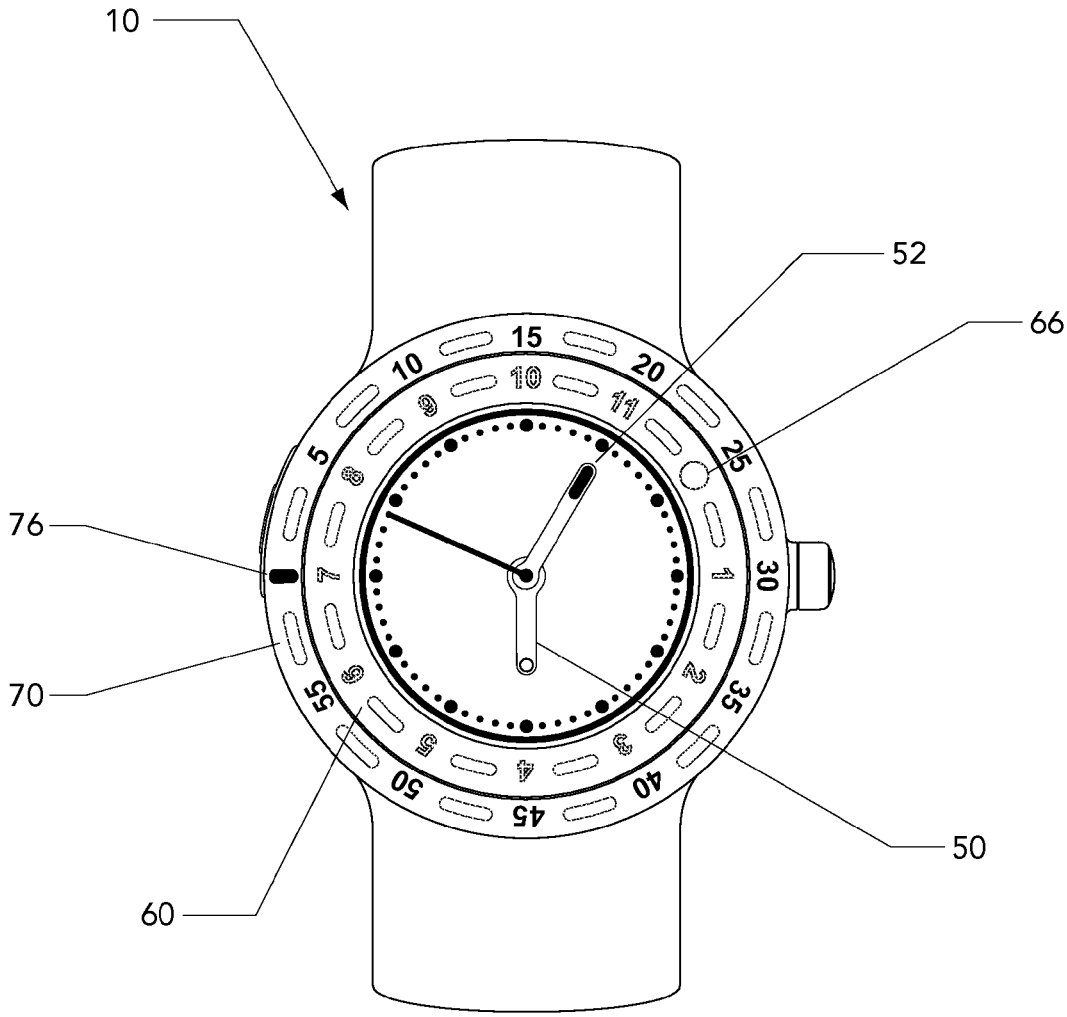
FIG. 3 is a plan view of the wristwatch of FIG. 2 showing the quantity of elapsed time.

With reference now to the drawing figures, FIGS. 1-3 depict an analog wristwatch 10 according to an example embodiment of the present invention. In many regards the wristwatch 10 is similar to a traditional known analog wristwatch, and as such, the wristwatch 10 of the present invention includes a band 20, a body unit 30 for housing the internal timekeeping mechanism(s), and a face dial 40 accompanied with hour and minute hands (50 & 52 respectfully) for designating the time, as best seen in FIG. 1*a*. The wristwatch 10 of the present invention uniquely includes at least two graduated bezels 60 & 70 that surround the circumference of the face dial 40. The internal movement of the wristwatch 10 can be driven by any one of a variety of possible mechanisms including a spring and balance wheel mechanical movement or an electronically controlled quartz movement.

Figure 4:
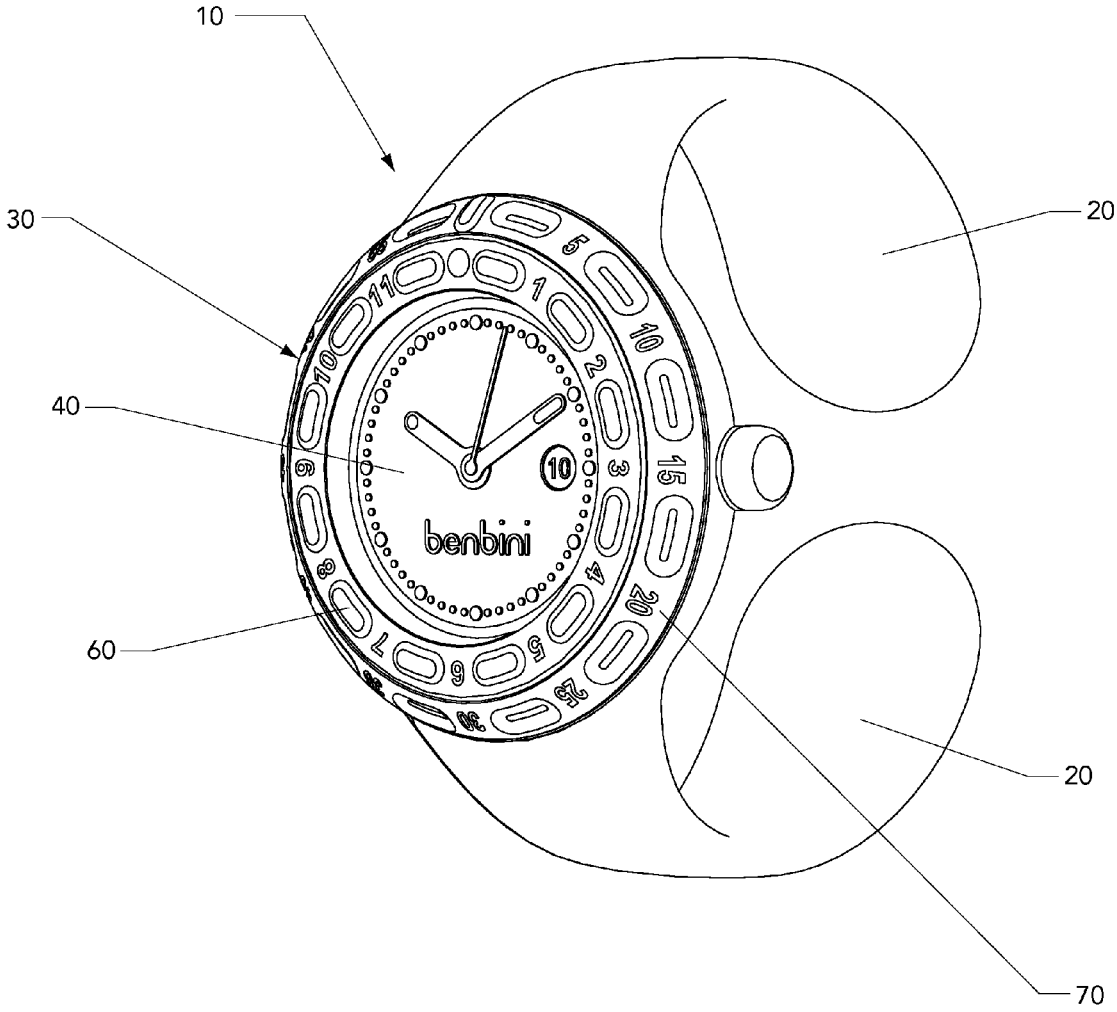
FIG. 4 is a perspective view of the wristwatch of FIG. 1, shown with an open bracelet band.

The band 20 of the wristwatch 10 can be adjustable to accommodate the various wrist sizes of potential wearers. It is conceivable that potential wearers of the wristwatch 10 of the present invention may need to constantly adjust the length of the band 20. For example, women who gain weight throughout a pregnancy, or divers who must adjust the watches band 20 to fit around a wetsuit, may have to adjust the length of the band multiple times. As such, in example embodiments, the band 20 can be made from one or more elastic materials to permit the band to stretch. In other embodiments, the band 20 can include a traditional latch for cooperating with incremental holes in the band for adjusting the length. In a particular commercial embodiment designed for pregnant women (although not limited to such), the band 20 can be an open bracelet design as shown in FIG. 4. In still other alternative embodiments, the present invention can be a pocket watch without a band or can include a clip for attaching the watch to a belt or other object, or can be a clock for mounting to a wall or sitting on a table.

The face dial 40 of the wristwatch 10 includes numbers and/or notations 44 that are equally spaced about the circumference of the dial for segmenting the dial into minutes and hours for displaying time. In example embodiments, the dial is preferably circular, but in other embodiments the dial can be any other shape including rectangular or elliptical. As with any wristwatch, the watch's internal movement rotates the hour and minute hands 50 & 52 and the relationship between the hands and the dial 40 indicate the time of the day to the wearer. Although FIG. 1*a* depicts the face dial 40 having only notations 44, this arrangement is certainly not a requirement of the present invention as many arrangements of numbers and notations can be used as desired by the wearer. In preferred embodiments, the numbers/notations 44, and/or the hands 50, 52 are coated in a luminous glow-in-the-dark material, are luminescent, and/or are capable of being illuminated so that a wearer can see what time it is in low light conditions.

In example embodiments, the wristwatch 10 has two bezels for measuring elapsed time, an inner bezel 60 for measuring elapsed hours, and an outer bezel 70 concentrically mounted around the inner bezel for measuring elapsed minutes. In other embodiments, an opposite arrangement can be employed such that the inner bezel 60 measures elapsed minutes while the outer bezel 70 measures elapsed hours. Regardless of the particular arrangement, the bezels 60 & 70 can be rotated about the circumference of the face dial 40 in graduated increments. In preferred embodiments, the rotation of the bezels is unidirectional, wherein it is preferred that the bezels rotate in a counterclockwise direction. In still other embodiments, the bezels can be ratcheted to help lock the bezels in place once set by a user. Two or more fingers of the wearer's non-watch wearing hand can easily rotate the bezels. However in commercial embodiments, to ease a user in manipulating one bezel at a time, the outer bezel 70 is raised above the plane of the watch face 40 and slanted at an angle towards the face. The inner bezel 60 is flat and on-plane with the face. The outer bezel 70 includes indentations 90 and the inner bezel 60 includes raised bumps 92 to aid a user in gripping the same, as best seen in FIGS. 1*a*-1*c*. To further differentiate the two bezels 60, 70, the bezels can be constructed of two different types of materials, such that one bezel can be formed from metal, and the other formed from plastic or rubber. The operation of the bezels will be further explained below.

In referring to the example embodiment as shown in FIG. 1*a*, the outer bezel 70 preferably measures the elapsed time in minutes (although in other embodiments the outer bezel can measure elapsed time in hours). As such, incremental elapsed minute indicia or notations 72 are imprinted along the circumference of the bezel 70 designating the minutes between 0 and 60. FIG. 1 shows the outer bezel 70 marking every five minutes with numbers 74 except for 0 and 60, which is marked with an arrow or other symbol 76. Therefore, the numbers 5, 10, 15, 20, 25, 30, 35, 40, 45, 50, 55, followed by an arrow/symbol 76, are equally spaced about the circumference of the bezel 70. The indicia 72 are radially spaced for alignment with the minute numbers and/or notations of the dial 40. The inner bezel 60 measures the elapsed time in hours, and therefore, is marked with elapsed hour indicia 62 for designating the hours elapsed between 0 and 12. As seen in FIG. 1, the inner bezel 60 is incrementally marked every hour with numbers 64 except for 0 and 12, which is also marked with an arrow or other symbol 66. Therefore, the numbers 1, 2, 3, 4, 5, 6, 7, 8, 9, 10, 11, followed by an arrow/symbol 66, are equally spaced about the circumference of the bezel 60. The indicia 62 are also radially aligned with the hour numbers and/or notations on the dial 40. As with both bezels 60 & 70, various combinations of indicia 62, 72 can be used to designate the markings around the circumferences of the bezels. For example, other embodiments can have more or less markings and can use other types of notations and/or numbers. Additionally, in preferred embodiments, the indicia 62, 72 can be luminescent or glow-in-the-dark so that they can be viewed by the wearer in low light conditions.

In operation, a wearer wishing to monitor elapsed time can rotate the inner bezel 60 until the hour arrow 66 radially aligns with the hour hand 50 and can rotate the outer bezel 70 until the minute arrow 76 radially aligns with the minute hand 52 as seen in FIG. 2. Optionally, in preferred embodiments the color of the hour hand 50 can match the color of the arrow/symbol 66 and the color of the minute hand 52 can match the color of the arrow/symbol 76 to make it easier for a wearer to quickly align and visually associate the respective bezels with the hour and minute hands. To further ease this association, the shape of the arrows/symbols 66, 76 can be imprinted onto the corresponding hour 50 or minute 52 hands, as shown in the drawing figures. Once the bezels have been set in place by the wearer, the wristwatch 10 can begin accurately measuring the elapsed time from this initial positioning of the bezels. As the hands 50, 52 of the wristwatch 10 move, the bezels stay fixed in place. The elapsed time can be measured by reading the numbers on the bezel that are aligned with the current location of the hands. As seen in FIG. 3, the time that has elapsed between the time shown in FIG. 2 is four hours and twenty minutes (4:20). Because two bezels 60, 70 are used, a wearer is able to monitor elapsed time of up to 12 hours. Prior art analog wristwatches 10 are only able to monitor elapsed time of up to one hour. In example embodiments, the bezels only rotate counterclockwise so that if a wearer unknowingly rotates the bezels, the measured elapsed time will err on the side of caution (showing more time has elapsed than actually has elapsed). In alternate embodiments, the bezels can be rotated clockwise so that if a wearer unknowingly rotates the bezels, the measured elapsed time will err on the side of showing less time has elapsed, which, for example, may be important when a wearer is monitoring elapsed time between medicine administration. Additionally, it is preferred, but not required, that the bezel that measures minutes be positioned on the outside so that if a bezel is accidentally rotated, the erred measurement will only be incorrect by minutes instead of hours.

The present invention has been found to be particularly useful for mothers with newborn children. For instance, mothers must monitor both the length of a breastfeeding session and the elapsed time between breastfeeding sessions. By using the wristwatch 10 of the present invention the wearer can set the bezels to the starting time of a session to monitor the length of the session. Once the session is over, a wearer can then set the bezels to the ending time of the session, allowing the wearer to accurately monitor the elapsed time since the child's last feeding session. Because it is important for breastfeeding mothers to know which breast was last used for a feeding session, example embodiments of the present invention can include at least one switch or button 80. The button or switch 80 can communicate with one or more indicators 84, 86 to alert a mother as to which breast was last used for a feeding session, as seen in FIGS. 1*b*-1*c*. By manipulating the button 80 to reveal the left indicator 84, the letter "L" or otherwise can be exposed to indicate that the left breast was used (FIG. 1*b*). Conversely, by manipulating the button 80 to reveal the right indicator 86, the letter "R" or otherwise can be exposed to indicate that the right breast was used (FIG. 1*c*). In preferred example embodiments, only one indicator can be viewable at one time. The at least one button or switch 80 can be positioned as desired on the wristwatch 10, however, in preferred embodiments, the switch 80 is positioned on a side face of the watch, as depicted in FIGS. 1*b*-1*c*. In commercial embodiments, the at least one button or switch 80 and the indicators 84, 86 are luminescent to be more easily viewable at night.

Other uses for the wristwatch 10 of the present invention that have been found to be particularly useful include: timing naps for young children, timing the contractions of pregnant women, monitoring the crying time of a newborn, monitoring dive times for advanced dives, timing athletic workouts and training-especially when running long distances, food preparation and cooking times, and transit times for delivery workers.

While the invention has been described with reference to preferred and example embodiments, it will be understood by those skilled in the art that a variety of modifications, additions and deletions are within the scope of the invention, as defined by the following claims.

What is claimed is:

1. A timekeeping device comprising:

a body housing an internal movement of the device;

a clock face coupled to the body, the face including a central dial representing a twelve hour analog time scale;

an hour hand and a minute hand in mechanical communication with the internal movement of the device, the hour and minute hands rotatably carried about said dial for indicating a particular time;

a first bezel rotatably mounted to the body and in coaxial alignment with the dial, the first bezel having a first index symbol and a first set of numerical indicia positioned about the circumference of the first bezel, the first set of numerical indicia representing an incremental hour scale; and a second bezel rotatably mounted to the body and in coaxial alignment with the dial and the first bezel, the second bezel having a second index symbol and a second set of numerical indicia positioned about the circumference of the second bezel, the second set of numerical indicia representing an incremental minute scale;

wherein the first index symbol is aligned with the position of the hour hand and the second index symbol is aligned with the position of the minute hand to establish a starting time, and whereby the amount of time that elapses from the starting time is visually indicated by the real time position of the hour hand and minute hand with respect to the first and second set of numerical indicia, respectively.

2. The timekeeping device of claim 1, wherein the first and second bezel each include a ratchet for communication with the body.

3. The timekeeping device of claim 1, wherein the device further comprises an adjustable band for securing the device to a user.

4. The timekeeping device of claim 3, wherein the band is an open bracelet.

5. The timekeeping device of claim 1, wherein the hour and minute hands are luminescent.

6. The timekeeping device of claim 1, wherein first bezel is positioned substantially about the circumference of the dial.

7. The timekeeping device of claim 6, wherein the second bezel is position substantially about the circumference of the first bezel.

8. The timekeeping device of claim 6, wherein the second bezel includes indentations.

9. The timekeeping device of claim 8, wherein the first bezel includes raised grips.

10. The timekeeping device of claim 1, wherein the first set of numerical indicia include the numbers 1, 2, 3, 4, 5, 6, 7, 8, 9, 10, and 11, and the second set of numerical indicia include the numbers 5, 10, 15, 20, 25, 30, 35, 40, 45, 50, and 55.

11. The timekeeping device of claim 1, wherein the first and second set of indicia are luminescent.

12. The timekeeping device of claim 1, wherein the first index symbol has a first color and the second index symbol has a second color, and wherein the first color is imprinted on the hour hand and the second color is imprinted on the minute hand.

13. The timekeeping device of claim 1, wherein the first index symbol has a first shape and the second index symbol has a second shape, and wherein the first shape is imprinted on the hour hand and the second shape is imprinted on the minute hand.

14. The timekeeping device of claim 1, wherein the device further comprises a indicator switch, the switch being movable from a first position to a second position.

15. An improvement for a clock of the type having a body for housing an internal movement of the clock, a central dial that represents a twelve hour analog time scale, and analog hour and minute hands, the improvement comprising:

a first bezel rotatably mounted to the body and coaxially aligned with the dial, wherein the first bezel includes twelve incremental indicia that represent twelve hours; and a second bezel rotatably mounted to the body and coaxially aligned with the dial and the first bezel, wherein the second bezel includes twelve incremental indicia that represent 60 minutes;

wherein the first bezel is aligned with the hour hand of the clock and the second bezel is aligned with the minute hand of the clock to establish a starting time, whereby a user can visualize the amount of time that has elapsed from the starting time by reading the indicia of the bezels that correspond to the position of the hour and minute hands.

16. The improvement of claim 15, wherein the first bezel is on-plane with the dial and the second bezel is raised above the plane of the dial and slanted at angle towards the face.

* * * * *